US008942582B2

(12) United States Patent
Toyama et al.

(10) Patent No.: US 8,942,582 B2
(45) Date of Patent: Jan. 27, 2015

(54) IMAGE FORMING APPARATUS

(71) Applicant: Fuji Xerox Co., Ltd., Tokyo (JP)

(72) Inventors: Toshimasa Toyama, Kanagawa (JP); Yoko Miyamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/948,467

(22) Filed: Jul. 23, 2013

(65) Prior Publication Data

US 2014/0112674 A1 Apr. 24, 2014

(30) Foreign Application Priority Data

Oct. 24, 2012 (JP) ..... 2012-234553

(51) Int. Cl.
*G03G 15/00* (2006.01)
*G03G 21/20* (2006.01)
*G03G 15/16* (2006.01)

(52) U.S. Cl.
CPC ..... *G03G 21/20* (2013.01); *G03G 15/1615* (2013.01); *G03G 15/1675* (2013.01); *G03G 2215/00776* (2013.01); *G03G 2215/0078* (2013.01); *G03G 2215/0129* (2013.01)
USPC ..... 399/44

(58) Field of Classification Search
CPC ..... G03G 15/1605
USPC ..... 399/44, 165, 302
See application file for complete search history.

(56) References Cited

U.S. PATENT DOCUMENTS

2007/0217832 A1* 9/2007 Oyama et al. ..... 399/302
2008/0285989 A1* 11/2008 Yagi ..... 399/44
2011/0026954 A1* 2/2011 Kishi ..... 399/44

FOREIGN PATENT DOCUMENTS

JP A-2004-163534 6/2004
JP A-2007-241014 9/2007
JP A-2007-248931 9/2007

* cited by examiner

*Primary Examiner* — Walter L Lindsay, Jr.
*Assistant Examiner* — Rodney Bonnette
(74) *Attorney, Agent, or Firm* — Oliff PLC

(57) ABSTRACT

An image forming apparatus includes a photoconductor; an intermediate transfer belt to which a toner image formed on the photoconductor is transferred, the intermediate transfer belt holding the toner image transferred thereto; a first transfer roller that nips the intermediate transfer belt between the first transfer roller and the photoconductor to transfer the toner image formed on the photoconductor to the intermediate transfer belt; a second transfer roller that transfers the toner image held by the intermediate transfer belt to a recording medium; a detection unit that detects an environmental condition; and a separation position changing unit that changes a first separation position in accordance with the environmental condition, the first separation position being a position at which the intermediate transfer belt becomes separated from the first transfer roller.

11 Claims, 2 Drawing Sheets

IMAGE FORMING APPARATUS

CROSS-REFERENCE TO RELATED APPLICATIONS

This application is based on and claims priority under 35 USC 119 from Japanese Patent Application No. 2012-234553 filed Oct. 24, 2012.

BACKGROUND (i) Technical Field

The present invention relates to image forming apparatuses.

(ii) Related Art

An image forming apparatus, such as a photocopier or a printer, includes a transfer device that transfers a toner image formed on a photoconductor to an intermediate transfer belt, which is stretched around components such as a backup roller and transportation rollers, and then transfers the transferred toner image to a recording medium. An image forming apparatus including such a transfer device is capable of being made compact if, for example, the intermediate transfer belt is allowed to be wound around freely.

SUMMARY

According to an aspect of the invention, an image forming apparatus includes a photoconductor; an intermediate transfer belt to which a toner image formed on the photoconductor is transferred, the intermediate transfer belt holding the toner image transferred thereto; a first transfer roller that nips the intermediate transfer belt between the first transfer roller and the photoconductor to transfer the toner image formed on the photoconductor to the intermediate transfer belt; a second transfer roller that transfers the toner image held by the intermediate transfer belt to a recording medium; a detection unit that detects an environmental condition; and a separation position changing unit that changes a first separation position in accordance with the environmental condition, the first separation position being a position at which the intermediate transfer belt becomes separated from the first transfer roller.

BRIEF DESCRIPTION OF THE DRAWINGS

Exemplary embodiments of the present invention will be described in detail based on the following figures, wherein.

DETAILED DESCRIPTION

Exemplary Embodiment

Figure 1:
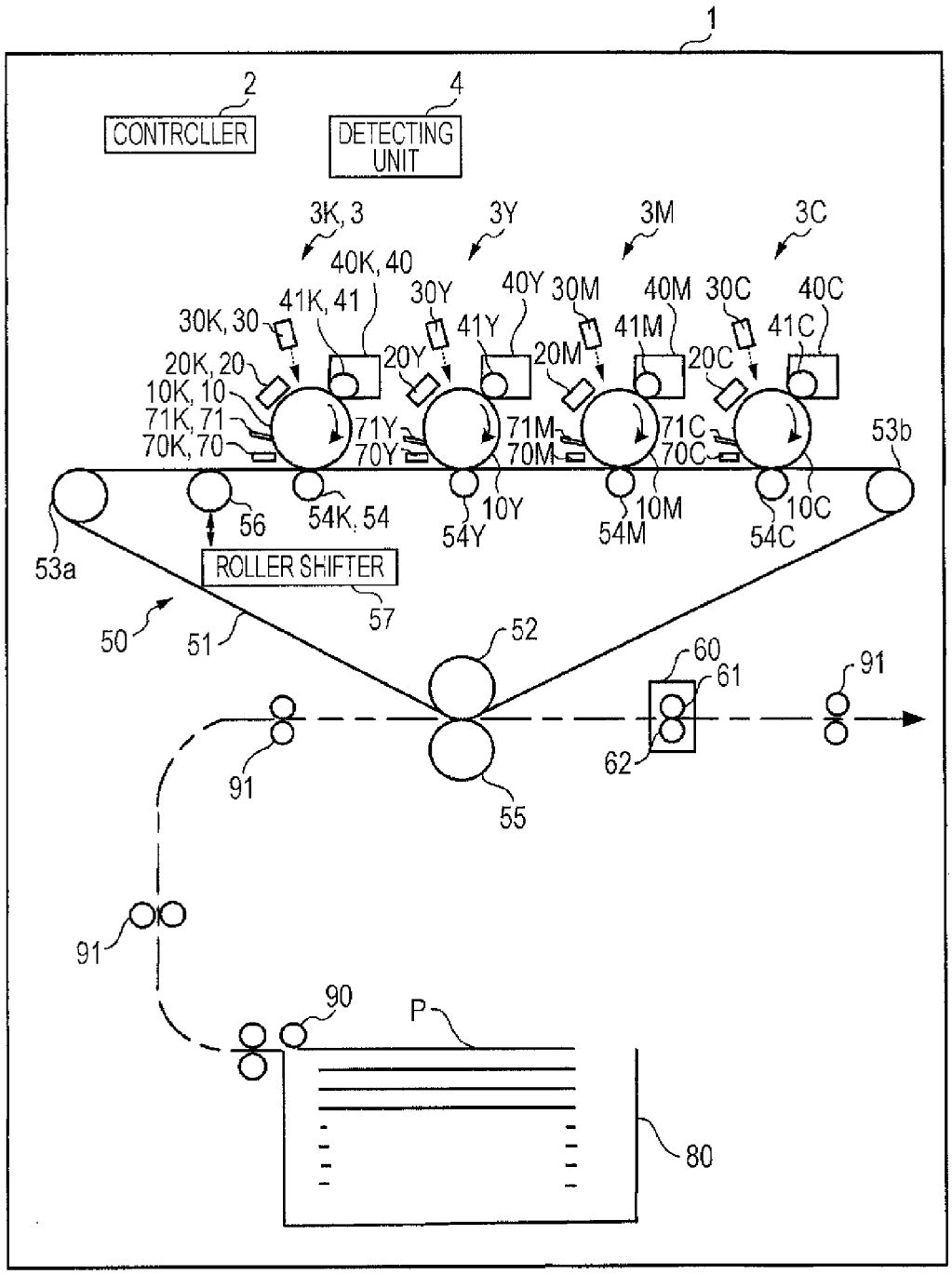
FIG. 1 is a schematic diagram of an image forming apparatus according to an exemplary embodiment.

Referring to the drawings, an exemplary embodiment of the present invention is described below. FIG. 1 schematically illustrates an image forming apparatus 1 according to the exemplary embodiment of the present invention. The image forming apparatus 1 according to the exemplary embodiment includes a controller 2, image forming units 3K, 3Y, 3M, and 3C, a detection unit 4, a transfer unit 50, a fixing unit 60, and a sheet storage 80. The detection unit 4 detects environmental conditions. The image forming apparatus 1 forms an image on a sheet P, which serves as a recording medium, or on other types of media on the basis of input image data supplied thereto.

The image forming units 3K to 3C form toner images of black (K), yellow (Y), magenta (M), and cyan (C). As illustrated in FIG. 1, each of the image forming units 3K to 3C includes a corresponding one of photoconductors 10K to 100, a corresponding one of charging units 20K to 20C, a corresponding one of exposure units 30K to 30C, a corresponding one of developing units 40K to 40C, a corresponding one of electric-charge eliminators 70K to 70C, and a corresponding one of cleaning units 71K to 71C. In the case where these components do not have to be distinguished from one another by their colors, for example, when the image forming units 3K to 3C do not particularly have to be distinguished from one another, each of the image forming units 3K to 3C is described simply as an image forming unit 3.

The controller 2 includes an arithmetic unit such as a central processing unit (CPU) and a memory to control operations of components of the image forming apparatus 1.

Each of the photoconductors 10 (10K to 10C) is a cylindrical rotating body that rotates in a direction of the arrow of FIG. 1 and that has a photosensitive layer made of an organic photosensitive material to hold an image.

Each of the charging units 20 (20K to 20C) applies a predetermined charging voltage to the surface of the corresponding photoconductor 10 using, for example, a charging roller that rotates while coming into contact with the surface of the photoconductor 10. Each charging unit 20 may be a contact-type charging unit that charges the photoconductor 10 while coming into contact with the photoconductor 10 using a brush or may be a non-contact-type charging unit that charges the photoconductor 10 using a corona discharge.

Each of the exposure units 30 (30K to 30C) emits light based on image data to the surface of the corresponding photoconductor 10 charged by the corresponding charging unit 20 and forms an electrostatic latent image having a latent image potential by using a potential difference. As the photoconductor 10 rotates, the electrostatic latent image moves to a position at which the corresponding developing unit 40 is disposed.

Each of the developing units 40 (40K to 40C) has a rotatable developing roller 41 (a corresponding one of the developing rollers 41K to 41C) and a toner adhering to the developing roller 41 transfers to the corresponding photoconductor 10. Specifically, the toner transfers to the surface of the photoconductor 10 due to there being a potential difference between the charged toner and the electrostatic latent image formed on the photoconductor 10. Consequently, a toner image is formed on the photoconductor 10. The toner image moves to a position at which the transfer unit 50 is disposed as the photoconductor 10 rotates.

The transfer unit 50 includes an intermediate transfer belt 51, a back-up roller 52, transportation rollers 53*a* and 53*b*, first transfer rollers 54 (54K to 54C), a second transfer roller 55, a belt-lifting roller 56, and a roller shifter 57. The transfer unit 50 transfers the toner images formed on the intermediate transfer belt 51 to a sheet P that has been transported thereto by transportation rollers 91. The sheet P to which the toner images have been transferred is transported to the fixing unit 60.

The intermediate transfer belt 51 is stretched around the transportation rollers 53*a* and 53*b* and the back-up roller 52. The intermediate transfer belt 51 is driven to rotate by driving, for example, the transportation roller 53*a*. The first transfer rollers 54 are disposed so as to face the photoconductors 10 with the intermediate transfer belt 51 interposed therebetween. Specifically, the first transfer roller 54K faces the photoconductor 10K and the other first transfer rollers 54 face the corresponding photoconductors 10.

Each of the first transfer rollers 54K to 54C is driven to rotate as the intermediate transfer belt 51 rotates. While rotating, the first transfer rollers 54K to 54C press the intermediate transfer belt 51 to transfer toner images formed on the photoconductors 10K to 10C to the intermediate transfer belt 51 so that the toner images are held on the intermediate transfer belt 51 in a stacked manner.

The second transfer roller 55 is disposed so as to face the back-up roller 52. The intermediate transfer belt 51 and a sheet P are nipped between the second transfer roller 55 and the back-up roller 52 and thus the toner images that have been transferred to the intermediate transfer belt 51 are transferred to the sheet P.

The belt-lifting roller 56 is a transportation roller that lifts the surface of the intermediate transfer belt 51 so that a nip portion in which the intermediate transfer belt 51 and the photoconductor 10 are in contact with each other is flattened. The roller shifter 57 moves the belt-lifting roller 56 in accordance with control of the controller 2 in a direction perpendicular to the direction in which the intermediate transfer belt 51 moves. The belt-lifting roller 56 and the roller shifter 57 controlled by the controller 2 are included in a separation position changing unit according to the exemplary embodiment, which will be described below.

The fixing unit 60 includes a heating roller 61, which includes a heat source, and a pressing roller 62, which is disposed opposite the heating roller 61. The heating roller 61 is pressed by the pressing roller 62. The fixing unit 60 fixes unfixed toner images formed on a sheet P to the sheet P by heating and pressing the toner images. The sheet P to which the toner images have been fixed by the fixing unit 60 is transported by transportation rollers 91 and then ejected to the outside.

Each electric-charge eliminator 70 (70K to 70C) eliminates, by, for example, irradiating the surface of the corresponding photoconductor 10 with light, electric charge remaining on the surface of the photoconductor 10 after the toner image formed on the photoconductor 10 has been transferred to the intermediate transfer belt 51 by the corresponding first transfer roller 54. The electric-charge eliminator 70 increases an amount of electric charge to be eliminated as the separation position changing unit starts operating.

Each of the cleaning units 71 (71K to 71G) removes remnants such as a toner remaining on the surface of the corresponding photoconductor 10 after the toner image has been transferred to the sheet P. Multiple sheets P are stored in the sheet storage 80. The sheets P are picked up by a pick-up roller 90 from the sheet storage 80 and transported to the transfer unit 50 by the transportation rollers 91.

Figure 2:
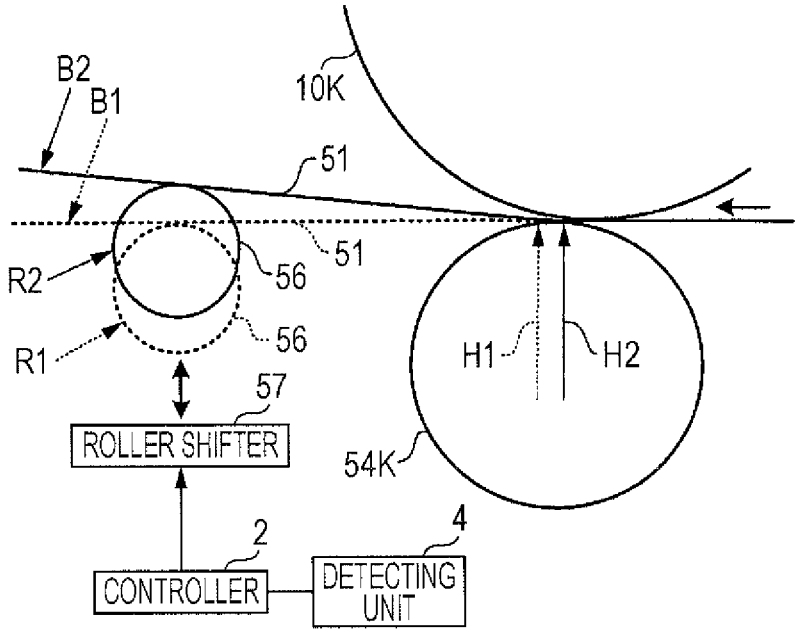
FIG. 2 is a schematic diagram of a separation position changing unit according to the exemplary embodiment.

Referring now to FIG. 2, a separation position changing unit according to the exemplary embodiment will be described. As mentioned above, the separation position changing unit includes the belt-lifting roller 56 and the roller shifter 57 controlled by the controller 2.

The detection unit 4 detects, for example, at least one of temperature or humidity as an environmental condition.

When the temperature and/or the humidity detected by the detection unit 4 exceeds a predetermined temperature and/or a predetermined humidity, the controller 2 determines the temperature and/or the humidity is high and transmits a signal to the roller shifter 57. Upon receipt of the signal, the roller shifter 57 moves the belt-lifting roller 56 in a direction perpendicular to the direction in which the intermediate transfer belt 51 moves.

Specifically, as illustrated in FIG. 2, upon receipt of the signal from the controller 2, the roller shifter 57 moves the belt-lifting roller 56 from, for example, a first roller position R1 to a second roller position R2. According to the movement of the belt-lifting roller 56, the intermediate transfer belt 51 is changed from a first belt position B1 to a second belt position B2.

According to the movement of the intermediate transfer belt 51, a position at which the intermediate transfer belt 51 and the first transfer roller 54K, which have been in contact with each other, become separated from each other is changed from a first separation position H1 to a second separation position H2.

Specifically, as illustrated in FIG. 2, the position at which the intermediate transfer belt 51 becomes separated from the first transfer roller 54K and then moves toward the second transfer roller 55 is changed from the first separation position H1 to the second separation position H2, which is positioned upstream from the first separation position H1 in the direction in which the intermediate transfer belt 51 moves. Here, an example of the roller shifter 57 is a driving mechanism that moves the belt-lifting roller 56 by using a cam. The temperature and/or the humidity detected by the detection unit 4 is input into the controller 2, which determines whether or not the temperature/humidity exceeds the predetermined temperature/humidity.

Now, a process in which the intermediate transfer belt 51 and the first transfer roller 54K become separated from each other will be described. The intermediate transfer belt 51 is typically controlled on the basis of the surface resistance, which is a resistance in the surface direction, and the volume resistance, which is a resistance in the thickness direction. If the intermediate transfer belt 51 has a low surface resistance, the electric field is more likely to expand, whereas if the intermediate transfer belt 51 has a high surface resistance, the electric field is more likely to be localized without expanding.

Typically, the surface resistance of the intermediate transfer belt 51 is affected to a lesser extent by environmental changes including temperature and humidity. On the other hand, the resistance of the first transfer roller 54K changes to a large extent due to such environmental changes. Thus, the first transfer roller 54K is often made of a material whose resistance decreases in hot and humid conditions and increases in cold and dry conditions.

In hot and humid conditions, the first transfer roller 54K has a low resistance and thus a small electric field occurs at the separation position at which the back side of the intermediate transfer belt 51 and the first transfer roller 54K become separated from each other.

If the electric field that occurs at the separation position is small, the amount of electric charge discharged on the back side of the intermediate transfer belt 51 may be too small to attract the toner image that has been transferred to the intermediate transfer belt 51 to it. If so, the toner image may be defectively transferred to a sheet P by the second transfer roller 55. Such defective transfer is prevented by, for example, the separation position changing unit appropriately regulating the amount of electric charge discharged during separation between the intermediate transfer belt 51 and the first transfer roller 54K.

The image forming apparatus 1 according to the exemplary embodiment achieves stable electric discharge between the intermediate transfer belt 51 and the first transfer roller 54K by having a simple configuration in which the roller shifter 57 causes the belt-lifting roller 56, disposed downstream from the image forming unit 3K, to lift the intermediate transfer belt 51 up and down.

In this configuration, the electric field that occurs at the separation position at which the intermediate transfer belt 51 and the first transfer roller 54K become separated from each other becomes larger and thus an allocation of a gap between the photoconductor 10K and the intermediate transfer belt 51 becomes smaller. Thus, the amount of electric charge discharged on the back side of the intermediate transfer belt 51 increases and a larger amount of electric charge transfer from the first transfer roller 54K to the intermediate transfer belt 51.

In this manner, the electrically charged states on the front and back sides of the intermediate transfer belt 51 are made stable, thereby preventing defective image formation. Secondary troubles due to an effect of electric discharge that occurs during separation between the photoconductor 10K and the intermediate transfer belt 51 are prevented from occurring by increasing the amount of electric charge to be eliminated from the photoconductor 10 by the electric-charge eliminator 70 to an optimum level.

Another Exemplary Embodiment

The image forming apparatus 1 according to the exemplary embodiment has been described thus far. The present invention, however, is not limited to the above-described exemplary embodiment and other exemplary embodiments are also conceivable. Now, other exemplary embodiments will be described.

In the separation position changing unit according to the exemplary embodiment, the roller shifter 57 moves the belt-lifting roller 56 in response to a signal from the controller 2, but the present invention is not limited to this configuration. For example, as illustrated in FIG. 3, the separation position changing unit may have a configuration in which an offset amount changing unit 58, which changes an amount of offset, is controlled by a signal from the controller 2.

In this separation position changing unit, upon receipt of a signal from the controller 2, the offset amount changing unit 58 moves the first transfer roller 54K in the same direction as the direction in which the intermediate transfer belt 51 moves. In other words, the offset amount changing unit 58 is a driving mechanism that moves the first transfer roller 54K by using a cam or other devices.

Here, offset is used to describe the state where a point at which the photoconductor 10 and the intermediate transfer belt 51 are in contact with each other (nip point) and a point at which the intermediate transfer belt 51 and the first transfer roller 54K are in contact with each other (nip point) do not coincide with each other. The amount of offset is a distance by which these points are separated from each other. In this manner, a sufficiently large transfer area between the photoconductor 10 and the intermediate transfer belt 51 is secured.

Figure 3:
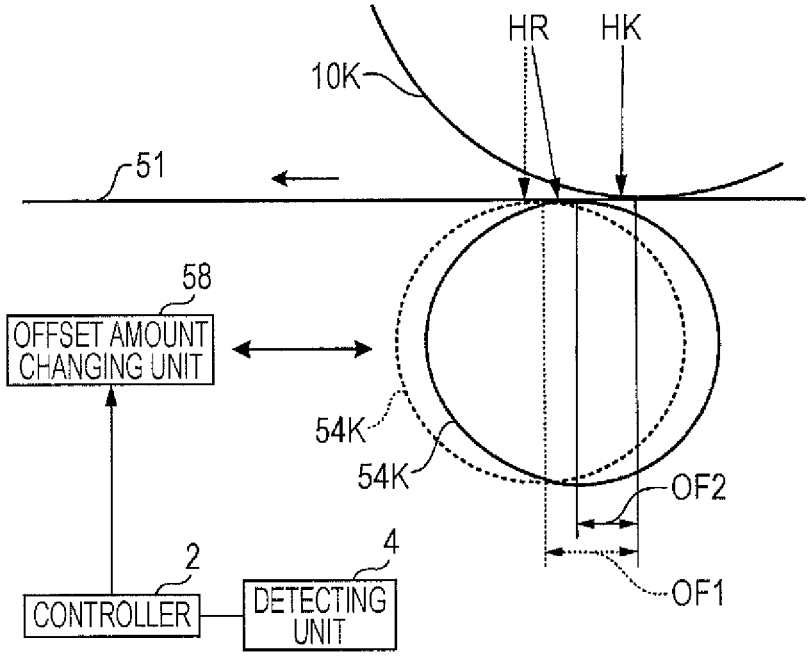
FIG. 3 is a schematic diagram of a separation position changing unit according to another exemplary embodiment.

The offset amount changing unit 58, which changes the amount of offset, moves the first transfer roller 54K to change the amount of offset from a first offset amount OF1 to a second offset amount OF2, as illustrated in FIG. 3, so as to reduce the distance between the nip points. In this manner, the separation position at which the intermediate transfer belt 51 and the first transfer roller 54K become separated from each other is changed.

Specifically, when a position at which the intermediate transfer belt 51 becomes separated from the first transfer roller 54K is denoted by a roller separation position HR and a position that is upstream from the roller separation position HR and at which the intermediate transfer belt 51 becomes separated from the photoconductor 10 and then moves toward the second transfer roller 55 is denoted by a photoconductor separation position HK, the roller separation position HR is changed to a upstream side in accordance with the change in amount of offset from the first offset amount OF1 to the second offset amount OF2. This change in amount of offset reduces a gap between the roller separation position HR and the photoconductor separation position HK, thereby changing the position at which the intermediate transfer belt 51 and the first transfer roller 54K become separated from each other.

In the exemplary embodiment, the amount of electric charge to be eliminated by the electric-charge eliminator 70 is changed in accordance with the change in the position at which the intermediate transfer belt 51 and the first transfer roller 54K become separated from each other. However, the present invention is not limited to this. For example, an image forming apparatus that does not include an electric-charge eliminator 70 is also conceivable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photoconductor;

an intermediate transfer belt to which a toner image formed on the photoconductor is transferred, the intermediate transfer belt holding the toner image transferred thereto;

a first transfer roller that nips the intermediate transfer belt between the first transfer roller and the photoconductor to transfer the toner image formed on the photoconductor to the intermediate transfer belt;

a second transfer roller that transfers the toner image held by the intermediate transfer belt to a recording medium;

a detection unit that detects an environmental condition; and a separation position changing unit that changes a first separation position in accordance with the environmental condition, the first separation position being a position at which the intermediate transfer belt becomes separated from the first transfer roller.

2. The image forming apparatus according to claim 1, further comprising an electric-charge eliminator that eliminates electric charge remaining on a surface of the photoconductor after the toner image is transferred to the intermediate transfer belt, wherein the electric-charge eliminator increases an amount of electric charge to be eliminated as the separation position changing unit operates.

3. The image forming apparatus according to claim 1, wherein the detection unit detects at least one of temperature and humidity.

4. The image forming apparatus according to claim 3, further comprising an electric-charge eliminator that eliminates electric charge remaining on a surface of the photoconductor after the toner image is transferred to the intermediate transfer belt, wherein the electric-charge eliminator increases an amount of electric charge to be eliminated as the separation position changing unit operates.

5. The image forming apparatus according to claim 3, further comprising a controller that causes the separation position changing unit to change the first separation position to a side further upstream in a direction in which the intermediate transfer belt moves when the at least one of the temperature and the humidity detected by the detection unit exceeds at least one of a predetermined temperature and a predetermined humidity.

6. The image forming apparatus according to claim 5, further comprising an electric-charge eliminator that eliminates electric charge remaining on a surface of the photoconductor after the toner image is transferred to the intermediate transfer belt, wherein the electric-charge eliminator increases an amount of electric charge to be eliminated as the separation position changing unit operates.

7. The image forming apparatus according to claim 5, wherein the first separation position changing unit is a transportation roller that lifts a portion of the intermediate transfer belt located downstream from the first separation position, and wherein the controller moves the transportation roller in a direction perpendicular to the direction in which the intermediate transfer belt moves.

8. The image forming apparatus according to claim 7, further comprising an electric-charge eliminator that eliminates electric charge remaining on a surface of the photoconductor after the toner image is transferred to the intermediate transfer belt, wherein the electric-charge eliminator increases an amount of electric charge to be eliminated as the separation position changing unit operates.

9. The image forming apparatus according to claim 3, further comprising a controller that causes the separation position changing unit to change a gap between the first separation position and a second separation position at which the intermediate transfer belt becomes separated from the photoconductor, wherein the controller causes the separation position changing unit to shorten the gap between the first separation position and the second separation position when the at least one of the temperature and the humidity detected by the detection unit exceeds at least one of a predetermined temperature and a predetermined humidity.

10. The image forming apparatus according to claim 9, further comprising an electric-charge eliminator that eliminates electric charge remaining on a surface of the photoconductor after the toner image is transferred to the intermediate transfer belt, wherein the electric-charge eliminator increases an amount of electric charge to be eliminated as the separation position changing unit operates.

11. The image forming apparatus according to claim 9, wherein the separation position changing unit moves a position of the first transfer roller to change the gap between the first separation position and the second separation position.

* * * * *